United States Patent [19]

Chibnik

[11] 4,083,699

[45] Apr. 11, 1978

[54] POLYOXYETHYLENE POLYAMINE MANNICH BASE PRODUCTS AND USE OF SAME IN FUELS AND LUBRICANTS

[75] Inventor: Sheldon Chibnik, Cherry Hill, N.J.

[73] Assignee: Mobil Oil Corporation, New York, N.Y.

[21] Appl. No.: 745,322

[22] Filed: Nov. 26, 1976

Related U.S. Application Data

[62] Division of Ser. No. 525,268, Nov. 19, 1974, Pat. No. 4,006,089.

[51] Int. Cl.[2] ..... C10L 1/22

[52] U.S. Cl. ..... 44/75; 44/73

[58] Field of Search ..... 260/570.5 P; 44/73, 44/75

[56] References Cited

U.S. PATENT DOCUMENTS

| | | | |
|---|---|---|---|
| 3,649,229 | 3/1972 | Otto | 44/73 |
| 3,734,965 | 5/1973 | Becker | 260/570.5 P |
| 3,944,397 | 3/1976 | Gardiner et al. | 44/73 |
| 3,948,619 | 4/1976 | Worrel | 44/73 |

*Primary Examiner*—Daniel E. Wyman
*Assistant Examiner*—Mrs. Y. Harris-Smith
*Attorney, Agent, or Firm*—Charles A. Huggett; Raymond W. Barclay; Claude E. Setliff

[57] ABSTRACT

The detergency properties of a fuel or a lubricant are improved by adding thereto a Mannich base product prepared by reacting a high molecular weight alkyl substituted hydroxyaromatic compound, a polyoxyethylene polyamine and an aldehyde.

23 Claims, No Drawings

POLYOXYETHYLENE POLYAMINE MANNICH BASE PRODUCTS AND USE OF SAME IN FUELS AND LUBRICANTS

CROSS-REFERENCE TO RELATED APPLICATIONS

This application is a division of copending application Ser. No. 525,268, filed Nov. 19, 1974, now U.S. Pat. No. 4,006,089.

BACKGROUND OF THE INVENTION

1. Field of the Invention

This invention relates to fuel and lubricant additives. More particularly, it relates to Mannich base products made from a high molecular weight alkyl-substituted hydroxyaromatic compound an aldehyde and a polyoxyethylenepolyamine.

2. Discussion of the Prior Art

A great deal of effort is being directed to providing a lubricant which will permit present-day automotive engines to be operated at a high level of efficiency over long periods of time. A difficulty arises because lubricating oils tend to deteriorate under the conditions of use, with attendant formation of sludge, lacquer and resinous materials which adhere to the engine parts, thereby lowering the operating efficiency of the engine. To counteract the formation of these deposits, certain chemical additives have been found which, when added to lubricating oils, have the ability to keep the deposit-forming materials suspended in the oil, so that the engine is kept clean and in efficient operating condition for extended periods of time. These added agents are known in the art as detergents or dispersants.

Metallo-organic compounds are particularly useful as additives in this respect. However, the troublesome deposits which form on the skirt of the piston and on the walls of the combustion chamber, as well as on valves and spark plugs are also partially attributable to these matal containing additives employed in the lubricant. Whenever oil is burned in the engine, as occurs with the oil film present on the cylinder wall during the combustion stroke, many metal containing additives present in the oil may form an ash which is partially deposited on the various surfaces of the combustion chamber and on those of the spark plugs and valves.

Several known non-metallic detergents have previously been used in lubricating compounds. However, they have not proved to be entirely satisfactory. Additives which are particularly effective are based upon condensation products of an hydroxyaromatic, an aldehyde and an amine, the so-called Mannich reaction. These additives are multi-functional improvers especially adapted for mineral oils and as pour depressants therein. These compounds have also been recognized as exhibiting detergent properties. A preference has existed for the use of hydroxyaromatics which are unsubstituted, particularly phenol and alpha and beta naphthols. Hydroxyaromatic compounds which are substituted by a short chain alkyl group or by a relatively high molecular weight straight chain chlorinated aliphatic hydrocarbon are also suitable such as the wax pehnols, referred to by E. A. Oberright, U.S. Pat. No. 2,459,144.

U.S. Pat. No. 3,734,965 discloses the use of short-chain phenols in making a phenolic resin. The reaction to produce such resin involves phenol per se or a short chain-substituted hydroxyaromatic compound, a polyoxyethylenepolyamine and an aldehyde. There is, however, no disclosure of the compounds having long chain-substituted phenol or of their use as fuel and lubricant additives.

SUMMARY OF THE INVENTION

The invention provides a Mannich base product which is the condensation product of (1) a polyalkylsubstituted hydroxyaromatic compound, wherein the polyalkylene has a number average molecular weight of from about 100 to about 4000, (2) an amine having one of the formulae $$NH_2\,CH(CH_3)CH_2\text{-}[OCH_2CH(CH_3)]_x\,NH_2$$

$$NH_2CH(CH_3)CH_2[OCH_2CH(CH_3)]_a\,[OCH_2CH_2]_b[OCH_2CH(CH_3)]_c\,NH_2$$

and $$\begin{array}{c} CH_2\text{-}[OCH_2CH(CH_3)]_l\,NH_2 \\ | \\ CH_3CH_2C\text{-}[OCH_2CH(CH_3)]_m\,NH_2 \\ | \\ CH_2\text{-}[OCH_2CH(CH_3)]_n\,NH_2 \end{array}$$

wherein $x$ is chosen such that the molecular weight of the amine is from about 142 to about 2000 ($x$ is from 1 to about 33), $b$ is zero or from about 10 to about 50, $a + c$ is about 3.5 and the sum of 1, $m$ and $n$ is from about 3 to about 10 and (3) an aldehyde wherein the respective molar ratios of reactants are 1:0.1–10:0.1–10.

The invention also provides lubricant and fuel compositions containing a detergency amount of the products, i.e., from about 0.05% to about 25% by weight, preferably from about 2% to about 10% by weight.

DESCRIPTION OF SPECIFIC EMBODIMENTS

In general aspect, the additive utilizable in this invention may be made from (1) a high molecular weight alkyl-substituted hydroxyaromatic compound, wherein the alkyl substituent has a number average molecular weight of from about 100 to about 4000, preferably from about 400 to about 2500, (2) an aldehyde and (3) an amine as described above.

The reaction involved in preparing the high molecular weight hydroxyaromatic compounds may be depicted as follows:

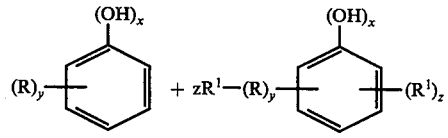

wherein R is a hydrocarbon or substituted-hydrocarbon radical, $R^1$ is a polyalkylene compound where the repeating alkyl unit may be from $C_2$ to $C_5$, $x$ is an integer from 1 to 2, $y$ is an integer from 0 to 2 and $z$ is an integer from 1 to 2. According to infrared spectroscopy, the final product is a mixture of ortho-, para- and 2,4-substituted phenols. The present invention is further predicated upon the discovery that this group of oil soluble fractions, in amounts of 0.05 to 25% will improve a lubricant by exhibiting high dispersant properties therein.

Representative high molecular weight alkyl substituted hydroxy-aromatic compounds comtemplated by the present invention are polypropylphenol, polybutyl-phenol, polyamylphenol and similarly substituted phenols. In place of the phenol, high molecular weight alkyl substituted compounds of resorcinol, hydroquinone, catechol, cresol, xylenol, amyl phenol, hydroxydiphenyl, benzylphenol, phenylethylphenol, phenol resins, methylhydroxydiphenyl, guiacol, alpha and beta naphthol, alpha and beta methylnaphthol, tolylnaphthol, xylylnaphthol, benzylnaphthol, anthnol, phenylmethylnaphthol, phenanthrol, monomethyl ether of catechol, phenoxyphenol, chlorophenol, hydroxyphenyl sulfides and the like may be used.

Aldehydes contemplated by the present invention are: the aliphatic aldehydes, typified by formaldehyde (such as trioxymethylene), paraformaldehyde, acetaldehyde and aldol (p-hydroxy butyraldehyde); aromatic aldehydes, representative of which is benzaldehyde, heterocyclic aldehydes, such as furfural; and the like. The aldehyde may contain a substituent group such as hydroxyl, halogen, nitro and the like; in short, any substituent which does not take a major part in the reaction. Preference, however, is given to the aliphatic aldehydes, formaldehyde and paraformaldehyde being particularly preferred.

Preferred examples of the polyoxypropylenamines of the present invention include polyoxypropylenediamine (average molecular weight abbreviated M.W. 190), polyoxypropylenediamine (M.W. 230), polyoxypropylenediamine (M.W. 240), polyoxypropylenediamine (M.W. 300), polyoxypropylenediamine (M.W. 400), polyoxypropylenediamine (M.W. 600), polyoxypropylenediamine (M.W. 700), polyoxypropylenediamine (M.W. 800), polyoxypropylenediamine (M.W. 1000), polyoxypropylenediamine (M.W. 1500), polyoxypropylenediamine (M.W. 2000), polyoxypropylenediamine (M.W. 700), polyoxypropylenetriamine (M.W. 1000) or mixtures of the same.

The polyalkyl hydroxyaromatic compounds of this invention may be made by reacting 0.1 to 10 moles of a phenol with 1 mole of a polyalkylene in the presence of an alkylating catalyst, such as $BF_3$ (including the etherate, phenolate or phosphonate complexes), $BF_3$ or HCl gas, $AlCl_3$, at 80° to 250° C. This process is particularly effective when conducted by reacting 1 to 1.5, or especially 1.25 moles, of phenol to 1 mole of polyalkylene compound in the presence of a $BF_3$ phenolate at about 150° C. The product is conveniently dissolved in an aromatic solvent and then washed with water to remove unreacted components. Upon filtration and removal of the aromatic solvent by distillation, the product, a clear, viscous oil, remains.

The preparation of the high molecular weight alkyl-substituted hydroxyaromatic compounds used in this invention may be illustrated by the preparation of polypropylphenol from phenol and polypropylene with a $BF_32C_6H_5OH$-catalyst. For example, the following was charged into a 30 gallon glass lined Pfaudler kettle:

34 kg. (42.5 mols) polypropylene (M.W. = 800)
5 kg. (42.5 mols + 25% excess) phenol. This includes 1.7 Kg. from the following 2.25 Kg complex.
2.25 kg. $BF_32C_6H_5OH$,26% $BF_3$ (585 g. $BF_3$)

The mixture was heated and stirred for 4 hours at 300° F, then it was cooled down to 175° F and 14 kg. toluene, 3.4 kg. butyl alcohol and 34 kg. distilled water were added to wash out the $BF_3$ and the unreacted phenol. After that the mixture in the kettle was washed with 5% aqueous KOH solution to remove any remaining phenol, then with 5% aqueous KCl solution to neutralize the unreacted KOH and finally three times with distilled water until neutral to litmus at a temperature in the vicinity of 150° F.

The washed mixture was filtered through a Sparkler Horizontal plate filter using 3/4 lb. of Hyflo filter aid (diatomaceous earth) and then the toluene and butyl alcohol were stripped off under vacuum (30–40 mm) at 300° F. The product, a clear, brown, viscous oil, gave the following analysis:

| | | |
|---|---|---|
| Active hydrogen (Zerenitinov determination): | | |
| Theory | mmoles $CH_4$/g | 1.1 |
| Found | mmoles $CH_4$/g | 0.85 |
| Yield based on the active H + analysis = 76.5% | | |
| Chromatographic clay separation = 73.5% yield. | | |

The high molecular weight alkyl substituted hydroxyaromatic compound used in this invention may be prepared by any other suitable means. The following examples illustrate the preparation of the high molecular weight Mannich bases used in this invention, wherein amounts are by weight, unless indicated otherwise.

EXAMPLE 1

Forty parts of polyoxypropylenediamine having a molecular weight of about 400 ($x$ in formula about 5.6) and 294 parts of polypropylphenol having a molecular weight of about 893 (phenol per se alkylated with polypropylene having a molecular weight of 800) were stirred at 70°–90° C and 7 parts of paraformaldehyde were added in portions over a 1.5 hour period. The mixture was held at 100°–110° C for 2 hours and then stripped of volatile materials at 150° C for 2 hours at 2 mm of Hg and filtered.

The procedure of Example 1 was followed to make the following compounds. The mole ratios were 2 phenol to 2 paraformaldehyde to 1 amine.

| | Alkylphenol | | Polyoxypropylene diamine | |
|---|---|---|---|---|
| Example | Alkylene Group | M. Wt. of Group | M. Wt. | x |
| 2 | polypropylene | 800 | 1000 | 15.8 |
| 3 | polybutylene | 2000 | 2000 | 33 |

EVALUATION OF PRODUCTS

Demulsibility

The products described above were examined for demulsibility by dissolving 1 part in 99 parts of 100″ solvent refined, paraffinic, neutral oil and testing in accordance with ASTM D-1401. In general, equal volumes of oil plus additive and water are stirred for 5 minutes at 130° F in a graduated cylinder. The time required for the separation of the emulsion thus formed is recorded. If separation does not occur after standing 1 hour, the volumes of oil, water and emulsion remaining at that time are reported.

Following are the results:

TABLE I

| Material of | Ml oil | Ml emulsion | Ml $H_2O$ |
|---|---|---|---|
| Example 1 | 9 | 71 | 0 |
| Example 2 | 6 | 74 | 0 |
| Example 3 | 40 | 0 | 40 |

SULFURIC ACID NEUTRALIZATION TEST

This method gives a measure of the ability of detergent additives to neutralize strong acids formed in engines operating on sulfur containing fuels. $H_2SO_4$ is mixed with a heated blend of the additive and the oil. A solution of this is formed in isooctane which is then centrifuged to separate insolubles. The optical density of the clear solution is then measured. From this value the optical density of the original additive blend diluted to a corresponding amount with isooctane is subtracted. The difference gives the optical density of the dispersed $H_2SO_4$ reaction products. The optical density of an acetone extraction of the isooctane-oil solution is then determined. The average optical density of the oil-isooctane solution is expressed as the optical density of the dispersed $H_2SO_4$ reaction product. The average density of the acetone solution is expressed as the optical density of the non-dispersant $H_2SO_4$ reaction products. The total of these values or either one alone is used in the evaluation of detergent additives.

PYRUVIC ACID DESCRIPTION TEST

This method gives a measure of the dispersant value of additives and serves to predict the performance of detergent additives in engines operating on low sulfur content fuels. When used in combination with the neutralization of $H_2SO_4$ bench test procedures it serves to predict the performance of detergent additives in engines operating on high sulfur content fuels. Pyruvic acid is mixed with a heated blend of the additive and the oil. The mixture is diluted with benzene and centrifuged to separate insolubles. The insolubles are dissolved in acetone. The optical density of the oil-benzene solution gives the total amount of color. From this value the optical density of the initial additive blend diluted with benzene to a corresponding amount is subtracted. This corrected value is expressed as the optical density of the dispersed pyruvic acid polymer. The optical density of the acetone solution is expressed as the optical density of the non-dispersed pyruvic acid polymer. These values are used in the evaluation of the detergent additives.

The following table summarizes the results from the sulfuric acid and pyruvic acid tests. The higher the percentage in the pyruvic acid test, the better the results. The lower the results in the sulfuric acid test, the better the additive.

Table 2

Blend of 3 Parts of Test Material with 96 Parts of SAE 30 Solvent Refined Lubricating Oil and 1 Part of Zinc Dihexylphosphorodithioate

| Material of | Pyruvic Acid, % | Sulfuric Acid |
|---|---|---|
| Blank | 58.6 | 0.102 |
| Example 1 | 97.8 | 0.003 |
| Example 3 | 62.4 | 0.05 |

TAPPING EFFICIENCY TESTS

This test measures the use of the materials in metal cutting fluids.

The data were obtained by means of a Tapping Efficiency Test and, in general, the procedure of this test involves measurement of torque developed in an internal threading operation employing SAE 1020 hot-rolled steel. In this test, thirty torque values are obtained with the test fluid and compared with thirty reference fluid values to obtain % Tapping Efficiency i.e., $$\% \text{ Tapping Efficiency} = \frac{\text{Av.30 Reference Fluid Torque Values} \times 100}{\text{Ave. 30 Test Fluid Torque Values}}$$

The reference fluid (or blank) employed in the aforementioned test comprised, by weight, 94% sulfurized mineral oil, 3% corrosive sulfurized fat and 3% oxidized $Ca/P_2S_5$ cutting fluid additive.

In general, the ability of a cutting oil to operate efficiently is measured by the tapping test. In the tapping test, a series of holes is drilled in a test metal such as SAE 1020 hot-rolled steel. The holes are tapped in a drill press equipped with a table which is free to rotate about the center on ball-bearings. A torque arm is attached to this "floating table" and the arm in turn activates a spring scale, so that the actual torque druing the tapping, with the oil being evaluated, is measured directly. The same conditions used in evaluating the test oil are employed in tapping with a strong oil which has arbitrarily been assigned an efficiency of 100%. The average torque in the test oil is compared to that of the standard and a relative efficiency is calculated on a percentage basis. For example,

| | |
|---|---|
| Torque with standard reference oil | 19.3 |
| Torque with test oil | 19.8 |
| Relative efficiency of test oil 19.3/19.8 × 100 | 97.4 |

This test is described by C. D. Flemming and L. H. Sudholz in Lubrication Engineering, volume 12, No. 3, May-June 1956, pages 199 to 203, and also in U.S. Pat. No. 3,278,432.

It should be noted, in accordance with the foregoing Tapping Efficiency Test that if the test fluid torque values exceed the reference value, Tapping Efficiency is below 100%. Criteria for product acceptance are evaluated as follows:

| Tapping Efficiency | Comments |
|---|---|
| >100% | Fluid considered outstanding and should outperform reference product in severe cutting operations. |
| 80–100% | Acceptable range for moderate duty cutting fluids. |
| < 80% | All products with Tapping Efficiencies below 80% are considered unacceptable. Torque values are erratic, frequently due to tap sticking and/or breakage. |

Employing the foregoing parameters the following data are obtained.

TABLE 3

| Material | %, Material | Efficiency |
|---|---|---|
| Blank | — | 95 |
| Example 2* | 7.0 | 104 |

*Fluid of the blank plus the material of Example 2

These tests indicate the substantial improvements in lubricants which can be obtained by the use of the novel compositions of matter of this invention. In particular, the excellent dispersant properties of these higher molecular weight mannich bases should be noted.

The additives of this invention can be used in any one of a wide variety of oils of lubricating viscosity, such an natural, refined or synthetic oils, or in blends of such oils. These oils may be prepared with or without auxiliary conventional additives such as: oiliness and extreme pressure agents; corrosion, oxidation and rust inhibitors; viscosity index improving agents; coloring agents and auxiliary detergents. The useful oils include mineral oils, both naphthenic and paraffinic, either of both containing aromatic fractions. They also include among the synthetic oils the synthetic hydrocarbon oils as well as synthetic ester oils prepared from, for example, monohydric alcohols and polyfunctional acids or from the polyhydric alcohols and monofunctional acids. In this latter category are esters prepared from pentaerythritol and a $C_5$ aliphatic mono acid such as valeric acid or from such alcohol and a mixture of $C_5$–$C_9$ aliphatic mono acids.

The fuels contemplated are liquid hydrocarbon combustion fuels, including the distillate fuels, i.e., gasolines and fuel oils. Accordingly, the fuel oils that may be improved in accordance with the present invention are hydrocarbon fractions having an initial boiling point of at least about 100° F and an end-boiling point no higher than about 750° F and boiling substantially continuously throughout their distillation range. Such fuel oils are generally known as distillate fuel oils. It is to be understood, however, that this term is not restricted to straight run distillate fractions. The distillate fuel oils can be straight run distillate fuel oils, catalytically or thermally cracked (including hydrocracked) distillate fuel oils, or mixtures of straight run distillate fuel oils, naphthas and the like, with cracked distillate stocks. Moreover, such fuel oils can be treated in accordance with well-known commercial methods, such as, acid or caustic treatment, hydrogenation, solvent refining, clay treatment, etc.

The distillate fuel oils are characterized by their relatively low viscosities, pour points, and the like. The principal property which characterized the contemplated hydrocarbons, however, is the distillation range. As mentioned hereinbefore, this range will lie between about 100° F and about 750° F. Obviously, the distillation range of each individual fuel oil will cover a narrower boiling range falling, nevertheless, within the above-specified limits. Likewise, each fuel oil will boil substantially continuously throughout its distillation range.

Contemplated among the fuel oils are Nos. 1, 2 and 3 fuel oils used in heating and as diesel fuel oils, and the jet combustion fuels. The domestic fuel oils generally conform to the specifications set forth in A.S.T.M. Specifications D396–48T. Specifications for diesel fuels are defined in A.S.T.M. Specification D975–48T. Typical jet fuels are defined in Military Specification MIL-F-5624B.

The gasolines that are improved by the additive compositions of this invention are mixtures of hydrocarbons having an initial boiling point falling between about 75° F and about 135° F and an end-boiling point falling between about 250° F and about 450° F. As is well known in the art, motor gasoline can be straight run gasoline or, as is more usual, it can be a blend of two or more cuts of materials including straight run stock, catalytic or thermal reformate, cracked stock, alkylated natural gasoline and aromatic hydrocarbons.

The invention has been described in terms of specific embodiments set forth in detail, but it should be understood that these are by way of illustration only and that the invention is not necessarily limited thereto. Alternative embodiments will become apparent to those skilled in the art in view of this disclosure, and accordingly, modifications of the product and process disclosed herein are to be contemplated within the spirit of this invention.

I claim:

1. A Mannich base product which is the condensation product of (1) a polyalkyl-substituted hydroxyaromatic compound, wherein the polyalkylene has a number average molecular weight of from about 100 to about 4000, (2) an amine having one of the formulae $$NH_2CH(CH_3)CH_2\text{—}[OCH_2CH(CH_3)]_x\text{—}NH_2$$

$$NH_2CH(CH_3)CH_2[OCH_2CH(CH_3)]_a\text{—}[OCH_2CH_2]_b[OCH_2CH(CH_3)]_c\text{—}NH_2$$

and $$\begin{array}{c} CH_2\text{—}[OCH_2CH(CH_3)]_l\text{—}NH_2 \\ | \\ CH_3CH_2C\text{—}CH_2\text{—}[OCH_2CH(CH_3)]_m\text{—}NH_2 \\ | \\ CH_2\text{—}[OCH_2CH(CH_3)]_n\text{—}NH_2 \end{array}$$

wherein $x$ is chosen such that the molecular weight of the amine is from about 142 to about 2,000, $b$ is zero or from about 10 to about 50, $a + c$ is about 2.5 and the sum of $l$, $m$ and $n$ is from about 3 to about 10 and (3) an aldehyde wherein the respective molar ratios of reactants are 1:0.1–10:0.1–10.

2. The product of claim 1 wherein the molecular weight of the alkyl substituent is from about 400 to about 2,500.

3. The product of claim 1 wherein the polyalkyl is polypropyl.

4. The product of claim 1 wherein the polyalkyl is polybutyl.

5. The product of claim 1 wherein the aldehyde is paraformaldehyde.

6. The product of claim 1 wherein the aldehyde is formaldehyde.

7. The product of claim 1 wherein the amine has a molecular weight of about 400.

8. The product of claim 1 wherein the amine has a molecular weight of 1,000.

9. The product of claim 1 wherein the amine has a molecular weight of about 2,000.

10. The product of claim 1 wherein the polyalkyl is polypropyl having a molecular weight of 800, the amine has a molecular weight of 400 and the aldehyde is paraformaldehyde.

11. The product of claim 1 wherein the polyalkyl is polypropyl having a molecular weight of 800, the amine has a molecular weight of 1,000 and the aldehyde is paraformaldehyde.

12. The product of claim 1 wherein the polyalkyl is polybutyl having a molecular weight of 2,000, the amine has a molecular weight of 2,000 and the aldehyde is paraformaldehyde.

13. A fuel composition comprising a major amount of a fuel and a minor amount of a Mannich base product which is the condensation product of (1) a polyalkyl-substituted hydroxyaromatic compound wherein the polyalkyl has a number average molecular weight of from about 100 to about 4,000, (2) an amine having one of the formulae $$NH_2\,CH(CH_3)CH_2\,[OCH_2CH(CH_3)]_x\,NH_2$$

$$NH_2CH(CH_3)CH_2[OCH_2CH(CH_3)]_a[OCH_2CH_2]_b[OCH_2CH(CH_3)]_c NH_2$$

and $$\begin{array}{c} CH_2\text{-}[OCH_2CH(CH_3)]_l NH_2 \\ | \\ CH_3CH_2C\text{-}CH_2\text{-}[OCH_2CH(CH_3)]_m NH_2 \\ | \\ CH_2\text{-}[OCH_2CH(CH_3)]_n NH_2 \end{array}$$

wherein $x$ is chosen such that the molecular weight of the amine is from about 142 to about 2,000, $b$ is zero or from about 10 to about 50, $a + c$ is about 2.5 and the sum of $l$, $m$ and $n$ is from about 3 to about 10 and (3) an aldehyde wherein the respective molar ratios of reactants are 1:0.1–10:0.1–10.

14. The composition of claim 13 wherein the molecular weight of the alkyl substituent is from about 400 to about 2,500.

15. The composition of claim 13 wherein the polyalkyl is polypropyl.

16. The composition of claim 13 wherein the polyalkyl is polybutyl.

17. The composition of claim 13 wherein the aldehyde is paraformaldehyde.

18. The composition of claim 13 wherein the amine has a molecular weight of about 400.

19. The composition of claim 13 wherein the amine has a molecular weight of 1,000.

20. The composition of claim 13 wherein the amine has a molecular weight of about 2,000.

21. The composition of claim 13 wherein the polyalkyl is polypropyl having a molecular weight of 800, the amine has a molecular weight of 400 and the aldehyde is paraformaldehyde.

22. The composition of claim 13 wherein the polyalkyl is polypropyl having a molecular weight of 800, the amine has a molecular weight of 1,000 and the aldehyde is paraformaldehyde.

23. The composition of claim 13 wherein the polyalkyl is polybutyl having a molecular weight of 2,000, the amine has a molecular weight of 2,000 and the aldehyde is paraformaldehyde.

* * * * *